United States Patent [19]

Verger et al.

[11] 3,940,725

[45] Feb. 24, 1976

[54] SWITCHING APPARATUS

[75] Inventors: Nathan Verger, Great Neck; Gerhard Schmidt, Rego Park, both of N.Y.

[73] Assignee: Alarm Device Manufacturing Co., Syosset, L.I., N.Y.

[22] Filed: Jan. 24, 1975

[21] Appl. No.: 543,672

Related U.S. Application Data

[63] Continuation of Ser. No. 440,660, Feb. 8, 1974, which is a continuation of Ser. No. 296,276, Oct. 10, 1972.

[52] U.S. Cl. ..... 335/207

[51] Int. Cl.[2] ..... H01H 36/00

[58] Field of Search..... 335/207, 206, 205

[56] References Cited

UNITED STATES PATENTS

| | | | |
|---|---|---|---|
| 3,689,716 | 9/1972 | Csurgay | 335/207 |
| 3,852,692 | 12/1974 | Moorman | 335/205 |

*Primary Examiner*—Harold Broome

*Attorney, Agent, or Firm*—Sommers & Sommers

[57] ABSTRACT

An apparatus for switching an alarm-signalling device which is connectable to a protective circuit so as to signal an alarm when a door or the like is displaced from its closed position in a jamb or the like by an intruder, in which the switching apparatus is mounted in the door and jamb or the like. The switching apparatus includes a switch which is connectable to the protective circuit, which is mounted in a housing which is installable so as to be recessed in the jamb, and a magnet which is magnetized such that opposite faces thereof define poles of opposite polarity, which is mounted in a housing which is installable so as to be recessed in the side of the door and disposed opposite the switch when the door is closed in the jamb. The switch includes a pair of contacts disposed in one end of the housing, a metal plate mounted in the other end of the housing, and a magnet which is reciprocally movable in the housing, which is magnetized such that opposite faces thereof define poles of opposite polarity, and which is disposed so that one pole thereof faces the metal plate, which pole is of the same polarity as the pole of the external magnet which is disposed opposite the portion of the housing in which the metal plate is mounted when the external magnet is positioned opposite the housing, so that the switch magnet is repelled by the external magnet when the external magnet is so positioned such that the switch magnet bears against the contacts to compress the contacts in a rolling and wiping action to close the protective circuit; when the door and external magnet are displaced from their closed position in the jamb, the switch magnet is attracted to the metal plate such that the contacts are released to open the protective circuit which actuates the alarm-signalling device.

12 Claims, 3 Drawing Figures

SWITCHING APPARATUS

BACKGROUND OF THE INVENTION

This application is a continuation of application Ser. No. 440,660 filed on Feb. 8, 1974, which was a continuation of application Ser. No. 296,276 filed on Oct. 10, 1972.

This invention relates generally to switching devices, and more specifically relates to an apparatus for switching an alarmsignalling device which is connected to a protective circuit so as to signal an alarm upon displacement by an intruder of a door or window or the like from its closed position in a jamb or frame or the like in which the switching apparatus is mounted.

Switching devices known heretofore included a switch which was connectable to a protective circuit and which was mounted in a housing which was installable on the outside surface of a jamb or frame or the like, and a magnet which was mounted in a housing which was installable on the outside surface of a door or window or the like; the exposed installation of such devices, which was necessary for proper operation thereof, subjected such devices to being circumvented or disconnected. The switch closing forces generated by such devices were insufficient to prevent opencircuiting of the protective circuit and signalling of false alarms upon movement thereof by extraneous forces acting thereon. Such devices were subject to defeat by insertion of an extraneous magnet between the switch and magnet, and were subject to switch teasing and breakdown by insertion of metal devices between the switch and magnet. The switch surfaces in such devices were subject to corrosion and pitting which generated arcing and interfered with proper switch operation.

SUMMARY OF THE INVENTION

In view of the foregoing, it is among the objects of this invention to provide a switching apparatus which is installable in a door and jamb or the like so as to be operable while being concealed therein, and which is operable to generate substantial switch closing and holding force. Among other objects of this invention are to provide such an apparatus which is substantially immune to defeat or teasing and breakdown by the use of extraneous devices, and which is operable to remove corrosion and pitting from switch surfaces.

In accordance with this invention, the foregoing objects and others are achieved in an apparatus for switching an alarmsignalling device which is connectable to a protective circuit so as to signal an alarm when a door or the like is displaced from its closed position in a jamb or the like by an intruder, in which the switching apparatus is mounted in the door and jamb or the like, which comprises a switch which is connectable to the protective circuit, and which is mounted in a housing which is installable so as to be recessed in the jamb, and a magnet which is magnetized such that opposite faces thereof define poles of opposite polarity, which is mounted in a housing which is installable so as to be recessed in the side of the door and disposed opposite the switch when the door is closed in the jamb. The recessed mounting of the switching apparatus and the orientation of the switch and magnet enable the apparatus to be operable while being concealed so as to prevent circumvention or disconnection thereof. The switch includes a pair of contacts disposed in one end of the housing, a metal plate mounted in the other end of the housing, a magnet which is reciprocally movable in the housing, which is magnetized such that opposite faces thereof define poles of opposite polarity, and which is disposed so that one pole thereof faces the metal plate, which pole is of the same polarity as the pole of the external magnet which is disposed opposite the portion of the housing in which the metal plate is mounted, when the external magnet is positioned opposite the housing, so that the switch magnet is repelled by the external magnet when the external magnet is so positioned such that the switch magnet bears against the contacts to compress the contacts in a rolling and wiping action to close the protective circuit; when the door and external magnet are displaced from their closed position in the jamb, the switch magnet is attracted to the metal plate such that the contacts are released to open the protective circuit which actuates the alarm-signalling device. The repelling magnetic force exerted by the external magnet on the switch magnet generates substantial closing and holding force on the contacts when the door is closed in the jamb so as to prevent opening of the contacts and signalling of false alarms upon movement of the apparatus by extraneous forces such as wind and vibration acting thereon. Such repelling magnetic force extends between the external magnet and the switch magnet in a narrow beam through openings in the metal plate so as to prevent defeat of the apparatus by the insertion of extraneous magnets or metal devices between the switch and external magnet. The rolling and wiping action of the contacts upon compression thereof removes corrosion and pitting from the contact surfaces and prevents arcing which would interfere with proper switch operation by signalling false alarms and leading to eventual switch breakdown.

DESCRIPTION OF THE DRAWINGS

This invention is illustrated by way of example in the drawings wherein.

DESCRIPTION OF THE PREFERRED EMBODIMENT

Figure 1:
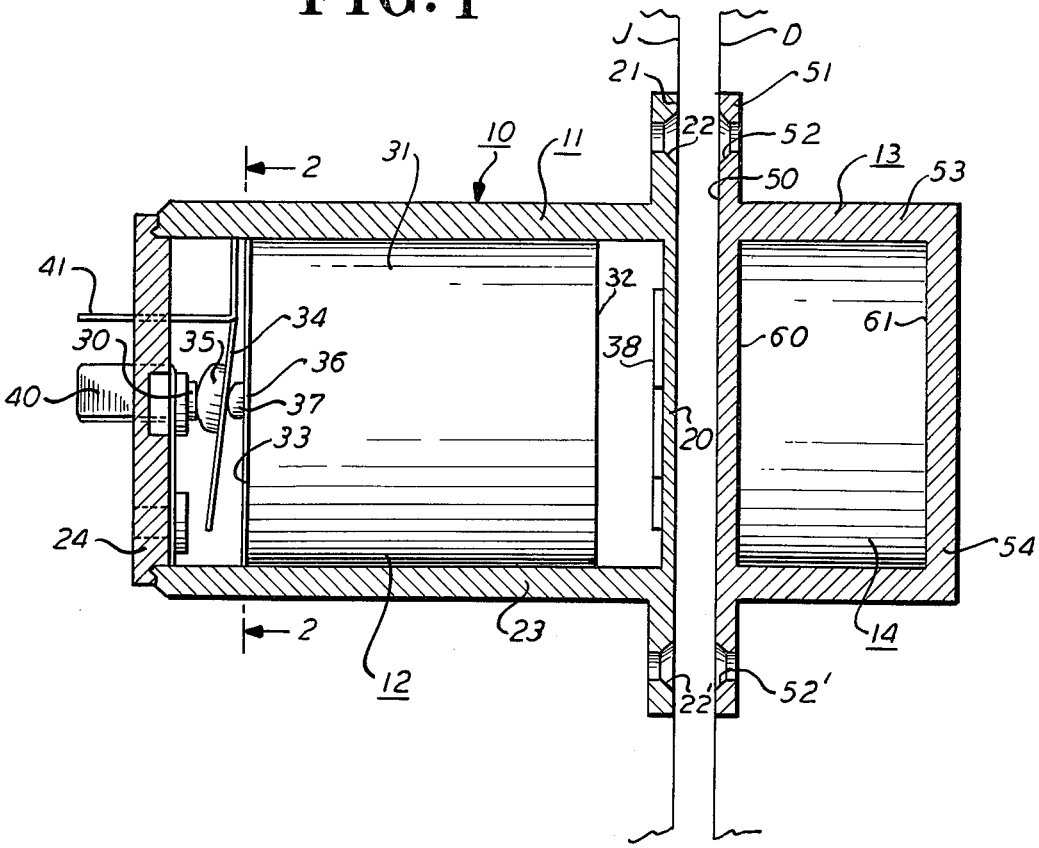
FIG. 1 is a side cross-sectional elevational view of a switching apparatus in accordance with the invention.

In the preferred embodiment of the invention as illustrated in FIG. 1, for example, the switching apparatus 10 comprises a housing 11 which is installable so as to be recessed in a jamb J, a switch 12 which is mounted in the housing 11 and which is connectable to a protective circuit to which an alarm-signalling device is connectable, a housing 13 which is installable so as to be recessed in the side of a door D and disposed opposite the housing 11 when the door D is closed in the jamb J, and a magnet 14 which is mounted in the housing 13.

Figure 2:
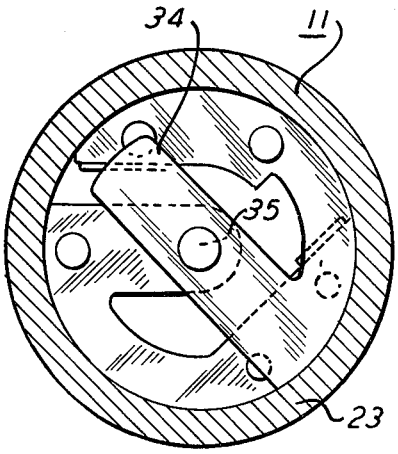
FIG. 2 is a front cross-sectional elevational view of the switch and housing taken at line 2—2 of FIG. 1.
Figure 3:
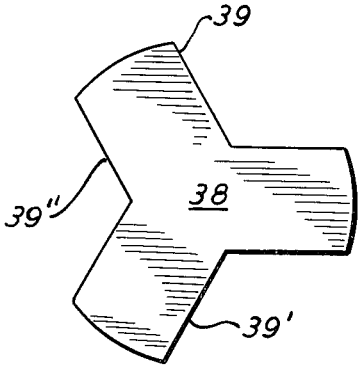
FIG. 3 is a front elevational view of the switch metal plate.

The housing 11 includes a front wall 20, including a concentric outer portion 21 having openings 22, 22' therein through which fasteners and securable into the jamb J to secure the housing 11 therein, a cylindrical side wall 23, and a back wall 24. The switch 12, as shown in FIGS. 1-3, comprises a contact 30 which is mounted on the inside surface of the back wall 24 of the housing 11, a cylindrical magnet 31 which is reciprocally movable along the inside surface of the side wall 23 of the housing 11 and which is magnetized so that the opposite faces thereof define poles of opposite polarity comprising a front pole 32 and a back pole 33, a resilient support arm 34 which extends into the housing 11 from the inside surface of the side wall 23 from a location intermediate the contact 30 and the back pole 33 of the magnet 31, a contact 35 which is mounted on the resilient support arm 34 so as to be disposed in alignment with and opposite to the contact 30, a disc 36 which is reciprocally movable along the inside surface of the side wall 23 of the housing 11 and which is disposed intermediate the resilient support arm 34 and the back pole 33 of the magnet 31, which includes a projecting portion 37 thereon which is aligned with the contact 35, a metal plate 38 which is mounted on the inside surface of the front wall 20 of the housing 11 opposite the front pole 32 of the magnet 31 and which includes cutout portions 39, 39′, 39″ therein, and terminal posts 40, 41′ which are connected to the contacts 30 and 35, and to which the leads from the protective circuit are connectable.

The housing 13 includes a front wall 50, including a concentric outer portion 51 having openings 52, 52′ therein through which fasteners are securable into the side of the door D to secure the housing 13 therein, a cylindrical side wall 53, and a back wall 54. The magnet 14 is magnetized so that the opposite faces thereof define poles of opposite polarity comprising a front pole 60 and a back pole 61. The front pole 60 of the magnet 14 is of the same polarity as the front pole 32 of the magnet 31.

The housings 11 and 13 may be installed in the jamb J and in the side of the door D by marking off the location of openings to be formed therein at locations which are opposite each other when the door D is closed in the jamb J, and drilling countersunk holes therein so that the outer surfaces of the front walls 20 and 50 of the housings 11 and 13 will be substantially flush with the outer surfaces of the door D and jamb J when installed therein, then pulling the leads from the protective circuit to which the alarm-signalling device is connectable through the opening drilled in the jamb J and connecting such leads to the terminal posts 40, 40′, and then securing fasteners through the apertures 22, 22′, and 52, 52′ in the concentric outer portions 21 and 51 of the housings 11 and 13 to secure the housings 11 and 13 in the jamb J and in the side of the door D. The recessed mounting of the housing 11 in the jamb J and of the housing 13 in the side of the door D, with the front pole 32 of the magnet 31 facing the front pole 60 of the magnet 14, and the concealment of the protective circuit leads, enables the switching apparatus 10 to be operable therein while preventing circumvention or disconnection thereof.

When the door D is closed in the jamb J, the magnet 14 is disposed opposite to and in alignment with the magnet 31, whereupon the front pole 60 of the magnet 14, which is of the same polarity as the facing front pole 32 of the magnet 31, repels the magnet 31 in the housing 11. The lines of repelling magnetic force extend between the magnets 31 and 14 in a narrow beam through the cutout portions 39, 39′, 39″ of the metal plate 38. Such narrow beam of repelling magnetic force prevents defeat or teasing or breakdown of the switch 12 by the insertion of extraneous magnets or metal devices between the housings 11 and 13. The repelling magnetic force exerted pushes the magnet 31 against the disc 36 such that the projecting portion 37 of the disc 36 pushes the resilient support arm 34 and the contact 35 mounted thereon so as to compress the contacts 33 and 35 such that the contact 35 makes contact with and wipes against the contact 33 to close the protective circuit. Substantial contact closing and holding force is generated by the repelling magnetic force between the magnets 14 and 30, which prevents opening of the contacts 33 and 35 and signalling of a false alarm upon movement of the switching apparatus 10 by extraneous forces such as wind and vibration acting thereon. The rolling and wiping action of the contacts 33 and 35 upon compression thereof removes corrosion and pitting from the contact surfaces and prevents arcing which would result in the signalling of false alarms and lead to eventual switch breakdown.

When the door D is displaced by an intruder from its closed position in the jamb J, the magnet 14 moves with the door D away from its position opposite the housing 11, whereupon the repelling magnetic force exerted by the magnet 14 on the magnet 31 diminishes and is overcome by the attracting force of the magnet 31 to the metal plate 38, which releases the resilient support arm 34 so as to push the disc 36 forward in the housing 11, and releases the contacts 33 and 35 so that the contact 35 breaks contact with the contact 33 to open the protective circuit, which actuates the alarm-signalling device.

In view of the foregoing disclosure it will be understood that while this invention has been set forth in terms of a specific embodiment thereof, variations may be made therein by those skilled in the art which are nevertheless within the scope and spirit of this invention and disclosure. Therefore, this invention is to be broadly construed within the scope and spirit of the claims.

We claim:

1. An apparatus for switching an alarm-signalling device, which is connectable to a protective circuit, which comprises:

a. a housing;

b. a switch which is disposed in the housing, which comprises:

1. a first contact;
2. a metal plate which is mounted in the housing;
3. a resilient support arm which extends into the housing from a location intermediate the first contact and the metal plate;
4. a second contact which is mounted on the resilient support arm so as to be disposed in alignment with and opposite to the first contact;
5. a first magnet which is reciprocally movable in the housing and which is magnetized so that opposite faces thereof define poles of opposite polarity, which is disposed so that one pole faces the resilient support arm and the other pole faces the metal plate; and
6. terminals connected to the first and second contacts, to which the leads from the protective circuit are connectable; and c. a second magnet which is magnetized so that opposite faces thereof define poles of opposite polarity and which is positionable so that one pole thereof faces the portion of the housing in which the metal plate is mounted, which pole is of the same polarity as the pole of the first magnet which faces the metal plate so that the second magnet repels the first magnet when so positioned.

2. A switching apparatus as recited in claim 1, in which the metal plate includes cutout portions therein.

3. A switching apparatus as recited in claim 1, further comprising a disc which is reciprocally movable in the housing, and which is disposed intermediate the resilient support arm and the first magnet.

4. A switching apparatus as recited in claim 1, in which the pole of the first magnet which faces the first contact includes a projecting portion thereon which is aligned with the second contact.

5. A switching apparatus as recited in claim 1, further comprising a second housing in which the second magnet is mounted.

6. A switching apparatus as recited in claim 1, in which the first housing includes a front wall, a side wall, and a back wall, and in which the first contact is mounted on the back wall, the resilient support arm extends from the side wall, the first magnet is movable along the side wall, and the metal plate is mounted on the front wall.

7. A switching apparatus as recited in claim 2, in which the metal plate is generally Y-shaped.

8. A switching apparatus as recited in claim 3, in which the disc further comprises a projecting portion which is aligned with the second contact.

9. A switching apparatus as recited in claim 5, in which the second housing includes a front wall including a concentric outer portion having openings therein, and a side wall.

10. A switching apparatus as recited in claim 6, in which the first magnet and the side wall of the first housing are generally cylindrical.

11. A switching apparatus as recited in claim 9, in which the second magnet and the side wall of the second housing are generally cylindrical.

12. A switching apparatus as recited in claim 10, in which the front wall of the first housing includes a concentric outer portion having openings therein.

* * * * *